US009174138B2

(12) United States Patent
Norman et al.

(10) Patent No.: US 9,174,138 B2
(45) Date of Patent: Nov. 3, 2015

(54) PLAYSETS WITH MOLDED SHELLS

(71) Applicant: Genie Toys plc, Cheltenham (GB)

(72) Inventors: Casey W. Norman, Gloucestershire (GB); David Gamlin, Bath (GB)

(73) Assignee: Genie Toys plc (GB)

( * ) Notice: Subject to any disclaimer, the term of this patent is extended or adjusted under 35 U.S.C. 154(b) by 118 days.

(21) Appl. No.: 13/944,044

(22) Filed: Jul. 17, 2013

(65) Prior Publication Data

US 2014/0256209 A1 Sep. 11, 2014

Related U.S. Application Data

(60) Provisional application No. 61/772,660, filed on Mar. 5, 2013.

(51) Int. Cl.
*A63H 3/08* (2006.01)
*A63H 3/52* (2006.01)
*A63H 3/16* (2006.01)

(52) U.S. Cl.
CPC ... *A63H 3/52* (2013.01); *A63H 3/16* (2013.01)

(58) Field of Classification Search
USPC ..... 446/97, 98, 268, 296, 321, 371, 474
See application file for complete search history.

(56) References Cited

U.S. PATENT DOCUMENTS

| | | | | |
|---|---|---|---|---|
| 2,283,238 | A | | 5/1942 | Thompson |
| 2,359,948 | A | | 10/1944 | Tillotson |
| 2,424,538 | A | * | 7/1947 | Beder ..... 446/69 |
| 2,942,271 | A | | 6/1960 | Frankenfield |
| 2,944,368 | A | | 7/1960 | O'Brian et al. |
| 2,954,562 | A | | 10/1960 | Krupp |
| 2,976,199 | A | | 3/1961 | Rand |
| 3,206,533 | A | | 9/1965 | Serra |
| 3,571,810 | A | | 3/1971 | Swett |
| 3,693,189 | A | | 9/1972 | Mundt |
| 3,707,289 | A | * | 12/1972 | Wicks ..... 273/139 |
| 3,781,916 | A | | 1/1974 | Vitol |
| 3,783,554 | A | | 1/1974 | Shapero |
| 3,918,195 | A | * | 11/1975 | Benson et al. ..... 446/353 |
| 4,063,402 | A | | 12/1977 | Washburn et al. |
| 4,067,064 | A | | 1/1978 | Cerniway et al. |
| 4,142,254 | A | | 3/1979 | Arnold |
| 4,190,982 | A | | 3/1980 | Rahmstorf |
| 4,206,564 | A | | 6/1980 | Ogawa |
| 4,227,340 | A | | 10/1980 | Goldfarb et al. |
| 4,294,036 | A | | 10/1981 | Wion |
| 4,297,153 | A | | 10/1981 | Erickson et al. |
| 4,297,313 | A | | 10/1981 | Duckstein |
| 4,344,249 | A | | 8/1982 | Goldfarb et al. |
| 4,414,774 | A | | 11/1983 | Fogarty et al. |
| 4,420,176 | A | | 12/1983 | Cornwall |

(Continued)

FOREIGN PATENT DOCUMENTS

| | | |
|---|---|---|
| GB | 835088 | 5/1960 |
| GB | 1 294 637 | 11/1972 |

(Continued)

*Primary Examiner* — Kurt Fernstrom
(74) *Attorney, Agent, or Firm* — DLA Piper LLP (US)

(57) ABSTRACT

A play set includes a molded shell which includes at least two contoured panels and at least one hinge assembly is provided. The play set may optionally further include a figurine. The molded shell may be configured to have the appearance of a garment. Preferably, the molded shell provides a natural appearance of a garment when mounted onto the figurine.

18 Claims, 4 Drawing Sheets

(56) References Cited

U.S. PATENT DOCUMENTS

| | | | | | |
|---|---|---|---|---|---|
| 4,453,271 | A | | 6/1984 | Donzis | |
| 4,509,213 | A | | 4/1985 | Harvey | |
| 4,509,930 | A | * | 4/1985 | Schweigert et al. | 446/109 |
| 4,595,378 | A | * | 6/1986 | Sweet et al. | 446/99 |
| 4,627,111 | A | | 12/1986 | Stoie | |
| 4,643,791 | A | | 2/1987 | Jurrius et al. | |
| 4,654,401 | A | | 3/1987 | Gallucci | |
| 4,681,564 | A | | 7/1987 | Landreneau | |
| 4,687,459 | A | * | 8/1987 | Lockett | 446/268 |
| 4,763,940 | A | | 8/1988 | Held | |
| 4,804,432 | A | | 2/1989 | Jurrius et al. | |
| 4,815,149 | A | | 3/1989 | Erhardt et al. | |
| 4,872,871 | A | | 10/1989 | Proxmire et al. | |
| 4,921,672 | A | | 5/1990 | Bock | |
| 4,940,464 | A | | 7/1990 | Van Gompel et al. | |
| 4,981,480 | A | | 1/1991 | Gaudet et al. | |
| 5,022,886 | A | | 6/1991 | Jenkins | |
| 5,082,875 | A | | 1/1992 | Tajima | |
| 5,090,569 | A | * | 2/1992 | Nissen et al. | 206/457 |
| 5,093,422 | A | | 3/1992 | Himes | |
| 5,163,932 | A | | 11/1992 | Nomura et al. | |
| 5,186,673 | A | | 2/1993 | Fogarty et al. | |
| 5,194,034 | A | | 3/1993 | Heppenstall | |
| 5,196,240 | A | | 3/1993 | Stockwell | |
| 5,261,848 | A | * | 11/1993 | Kaplan et al. | 446/74 |
| 5,352,649 | A | | 10/1994 | Shibahashi et al. | |
| 5,357,636 | A | | 10/1994 | Dresdner, Jr. et al. | |
| 5,388,275 | A | | 2/1995 | Oram | |
| 5,423,087 | A | | 6/1995 | Krent | |
| 5,451,439 | A | | 9/1995 | Bigg | |
| 5,453,314 | A | | 9/1995 | Collier et al. | |
| 5,472,775 | A | | 12/1995 | Obijeski et al. | |
| 5,480,341 | A | * | 1/1996 | Plakos | 446/373 |
| 5,503,919 | A | | 4/1996 | Litchholt et al. | |
| 5,531,732 | A | | 7/1996 | Wood | |
| 5,553,399 | A | | 9/1996 | Strong | |
| 5,569,265 | A | | 10/1996 | Elliott | |
| 5,586,340 | A | | 12/1996 | Russo | |
| 5,603,122 | A | | 2/1997 | Kania | |
| 5,607,339 | A | | 3/1997 | Kramer | |
| 5,625,897 | A | | 5/1997 | Park | |
| 5,640,720 | A | | 6/1997 | Sandbank | |
| 5,643,396 | A | | 7/1997 | Rajala et al. | |
| 5,709,913 | A | | 1/1998 | Andersen et al. | |
| 5,718,669 | A | | 2/1998 | Marble | |
| 5,766,704 | A | | 6/1998 | Allen et al. | |
| 5,780,573 | A | | 7/1998 | Iwata et al. | |
| 5,913,708 | A | | 6/1999 | Gross | |
| 5,928,803 | A | | 7/1999 | Yasuda | |
| 5,944,577 | A | * | 8/1999 | Yanofsky et al. | 446/371 |
| 5,951,358 | A | * | 9/1999 | Hilko et al. | 446/147 |
| 5,997,989 | A | | 12/1999 | Gessner et al. | |
| 6,227,930 | B1 | | 5/2001 | Norman et al. | |
| 6,228,804 | B1 | | 5/2001 | Nakashima | |
| 6,231,346 | B1 | * | 5/2001 | Sagi-Dolev | 434/295 |
| 6,475,609 | B1 | | 11/2002 | Whitney et al. | |
| 6,568,986 | B2 | * | 5/2003 | Kobayashi | 446/268 |
| 6,803,142 | B2 | | 10/2004 | Tanaka et al. | |
| 6,883,205 | B2 | * | 4/2005 | Martinez-Munoz | 16/251 |
| 7,448,932 | B2 | | 11/2008 | Buckley et al. | |
| 7,512,426 | B2 | * | 3/2009 | Maatta et al. | 455/575.1 |
| 7,597,209 | B2 | * | 10/2009 | Rothschild et al. | 220/23.87 |
| 8,333,634 | B2 | | 12/2012 | Norman et al. | |
| 2010/0041301 | A1 | | 2/2010 | Phillips | |
| 2010/0210171 | A1 | * | 8/2010 | Chan | 446/98 |

FOREIGN PATENT DOCUMENTS

| | | |
|---|---|---|
| GB | 1 518 830 | 7/1978 |
| GB | 2 318 523 | 4/1998 |
| KR | 1984-0000137 | 7/1984 |

* cited by examiner

PLAYSETS WITH MOLDED SHELLS

TECHNICAL FIELD

This disclosure relates to articles useful for affixing a garment to figurines such as dolls. The disclosure also relates to play sets comprising a molded shell that can be removeably mounted onto a figurine such as a doll or vehicle,

BACKGROUND

Children report again and again that a frustrating aspect of fashion dolls is the time and difficulty in dressing and changing the clothing for their dolls. Attempts to overcome this have often resulted in clothing that lacks the realism and style of the best fabric garments.

For example, U.S. Pat. No. 7,448,932 provides a doll dress up set in which garments include two separate halves that can be coupled together on either side of the doll. However, the use of two separate halves can be undesirable because one of the two halves may be easily lost or misplaced by a child.

US 2010/0041301 to Phillips attempts to resolve the problem of separate parts by providing an article of doll clothing having two sections joined by a clasp wherein the article can be clipped onto a doll by compressing protrusions extending from the clasp. However, the requirement of protruding members to operate the clasp is undesirable because the doll clothing does not approximate the appearance of real clothing due to these protrusions. While Phillips camouflages the protruding members in the clasp region as butterfly wings, the protrusions would be unsightly in doll clothing that does not have similar wing-like appendages.

Other attempts to provide doll clothing, such as that described in U.S. Pat. No. 8,333,634, have been more successful in providing suitable doll clothing. For example, this document discloses a hinged frame that can be attached to fabric garments and mounted onto a doll. However, there continues to be a need for additional devices and play sets that permit garments to be quickly mounted onto or removed from figurines such as dolls, without difficulty or unsightly protrusions.

SUMMARY

We provide a play set comprising a molded shell which comprises at least two contoured panels and at least one hinge assembly pivotally joining the contoured panels. The hinge assembly comprises at least two pin members, with each pin member being fixed to one of the contoured panels, and a flexible material. Preferably, a contour of an outer surface of the hinge assembly is continuous with the outer contoured surface of the contoured panels. The play set may optionally comprise a figurine.

DETAILED DESCRIPTION

We provide play sets comprising a molded shell which can be easily mounted onto a doll or figurine. The molded shell may be shaped or ornamented to approximate an article of clothing, a piece of armor, an outer skin or shell any portion thereof or the like. Advantageously, the molded shell does not require protruding mechanisms for attachment or removal so it can be mounted onto a doll or figurine and give a natural appearance of a garment. Additionally, the molded shell may be configured to be mounted to a vehicle or other structure, rather than a doll. Examples of molded shells consistent with this disclosure are described below with reference to the figures. However, it will be appreciated that the following description is intended to provide details concerning specific representative aspects of the disclosure and are not limiting beyond what is recited in the appended claims.

Figure 1B:
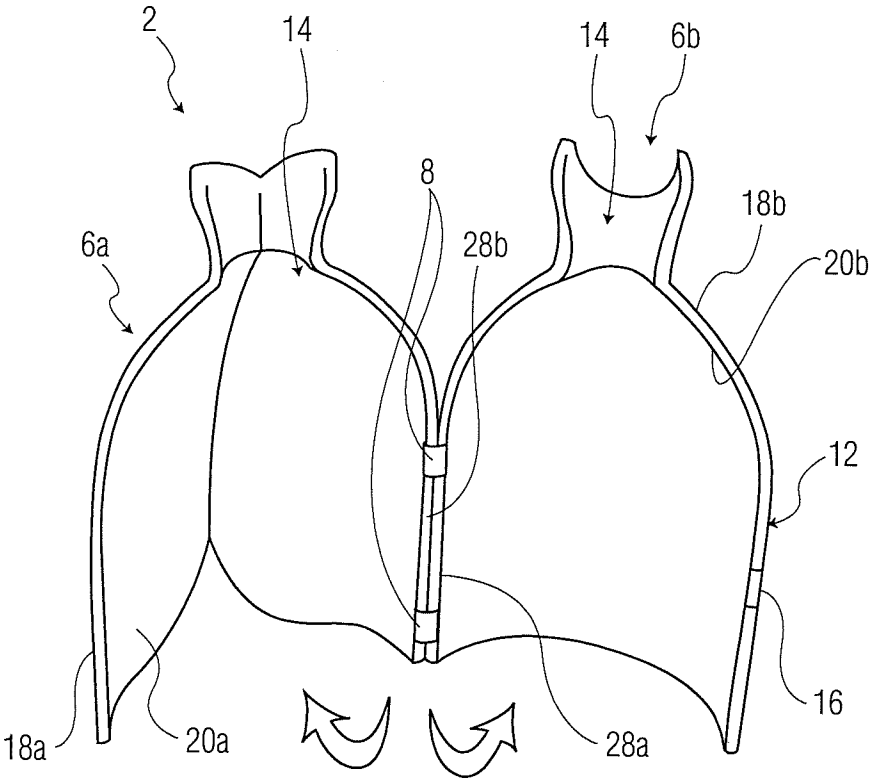
FIG. 1B is a perspective view of the molded shell depicted in FIG. 1A in an open position.
Figure 1A:
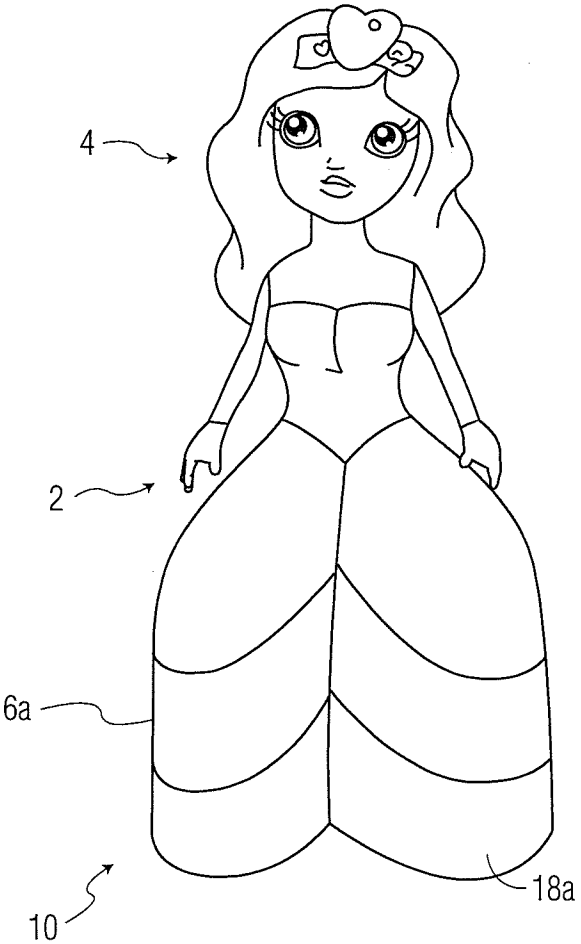
FIG. 1A is a front view of an exemplary play set with an exemplary molded shell mounted on an exemplary figurine.

Turning now to FIGS. 1A and 1B, an exemplary play set 10 is shown. Play set 10 comprises a molded shell 2 and figurine 4. The molded shell 2 is shown having the appearance of a dress and is mounted on the figurine 4 in FIG. 1A. While the figurine 4 is shown as a doll with the likeness of a human in FIG. 1A, it can be formed in the likeness of an animal, creature, or object without departing from the scope of this disclosure. For example, the figurine can be in the form of a vehicle, such as a car, truck or the like, or another natural or non-natural structure, such as a building, tree or the like. Accordingly, it should be understood that the term "figurine" as used herein is not limited to dolls having a human likeness and description referring to humanoid figurines can readily be applied to non-humanoid figurines.

As best seen in FIG. 1B, a molded shell 2 comprises at least two contoured panels 6*a* and 6*b*, which can have a constant or variable thickness. As shown, the two contoured panels 6*a* and 6*b* are joined by at least one hinge assembly 8. While a molded shell 2 is provided with at least one hinge assembly 8 to join two contoured panels 6, two contoured panels 6 may be joined by two or more hinge assemblies 8. Additionally, a molded shell 2 may comprise more than two contoured panels 6 and a plurality of hinge assemblies 8 joining the contoured panels 6.

The hinge assembly 8 pivotally mounts the contoured panels 6*a,b* to one another. Thus, the contoured panels 6 of the molded shell 2 are moveable between a closed position (shown in FIG. 1A) and an open position (shown in FIG. 1B) or any position therebetween by pivoting the contoured panels 6*a,b* at the hinge assembly 8. The molded shell 2 can be moved from the closed position towards the open position by gripping and spreading the contoured panels 6*a,b* and causing the contoured panels 6*a,b* to pivot at the hinge assembly 8 (shown by arrows in FIG. 1B). The molded shell 2 can be returned to the closed position by pivoting the contoured panels 6*a,b* towards one another so that a portion of the edge 12*a,b* of each contoured panel 6*a,b* opposite the hinge assembly 8 converges.

When the molded shell 2 is in the open position, a figurine 4 can be removed from the molded shell 2. Alternatively, the figurine 4 may be placed between the contoured panels 6*a,b* of the molded shell 2 and the contoured panels 6*a,b* can be moved towards the closed position to mount the molded shell 2 to the figurine 4.

As shown in FIGS. 1A and 1B, each contoured panel 6 has an outer contoured surface 18 and an inner contoured surface 20. When the molded shell 2 is in the closed position, the outer contoured surface 18*a,b* of each contoured panel 6*a,b* faces outwardly and the inner contoured surface 20*a* of one contoured panel 6*a* faces the inner contoured surface 20*b* of the other contoured panel 6*b*.

In preferred examples, a portion of the outer contoured surface 18 is shaped and/or ornamented to approximate the appearance of a portion of an article of clothing, a piece of armor or a portion of outer skin. For example, as best seen in FIG. 1A, the outer contoured surface 18*a* of a first contoured panel 6*a* approximates the front portion of a dress. Likewise, the outer contoured surface 18*b* of a second contoured panel 6*b* approximates the rear portion of a dress. Together, the outer contoured surfaces 18*a,b* two contoured panels 6*a,b* approximate the appearance of a complete dress when the molded shell 2 is mounted on the figurine 4.

However, the outer contoured surface 18 of the molded shell 2 may approximate the appearance of other garments, including but not limited skirts, pants, jackets, shirts and the like. The outer contoured surface 18 of the molded shell 2 may also approximate the appearance of other items, including suits of armor or a removable outer skin of a creature or object. Additionally, it should be appreciated that the contoured panels 6 are not limited to approximating either the front or rear of a garment, but can also approximate a side or any other portion of a garment by appropriate positioning of the hinge assembly 8.

Figure 2A:
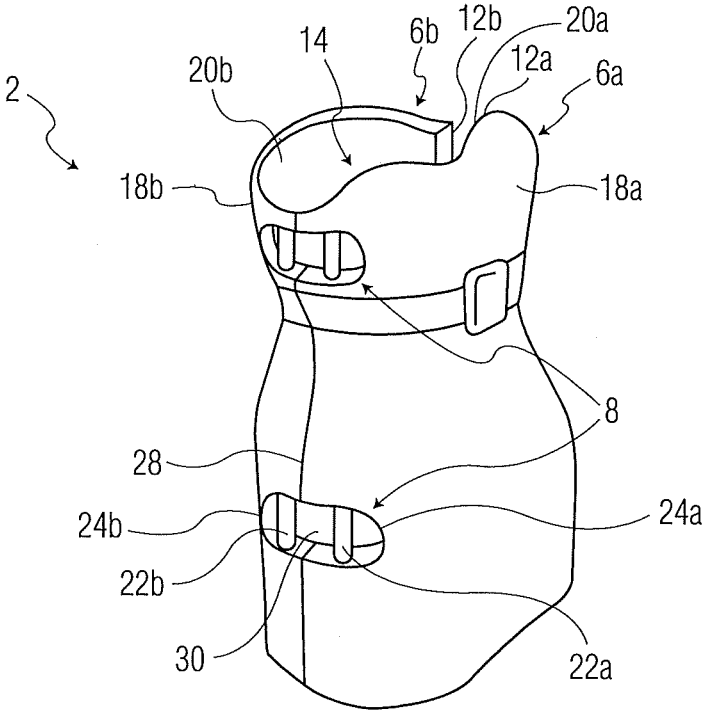
FIG. 2A is a perspective view of exemplary contoured panels of an exemplary molded shell.

As shown in FIG. 1B, a portion of the inner contoured surface 20*a,b* of each of the contoured panels 6*a,b* cooperates to define a cavity 14 when the molded shell 2 is in the closed position (see, generally, FIGS. 1A and 2A). For example, as shown by example in FIG. 1B, a portion of the inner contoured surface 20*a* of contoured panel 6*a* may be generally convexly curved whereas a corresponding portion of the inner contoured surface 20*b* of the other contoured panel 6*b* may be generally concavely curved so that the two contoured panels 6*a,b* cooperate to generally define the cavity 14 (seen best in FIG. 2A). As shown, the inner contoured surfaces 20*a,b* may be defined by a curvature of a portion of the contoured panels 6*a,b* such that the cross-section of a portion of each contoured panel 6*a,b* is generally arcuate and the contoured panels 6*a,b* cooperate to define a generally ring-shaped cross-section when the molded shell 2 is in the closed position. However, other cross-sections are contemplated. For example, the inner contoured surfaces 20*a,b* of the contoured panels 6*a,b* may define an irregular cross-section having both concave and convex curvatures provided that at least a portion of the contoured panels 6*a,b* cooperate to define a cavity 14 when the molded shell 2 is placed in the closed position. However, it will be appreciated that portions of the edges 12*a,b* of the contoured panels 6*a,b* are not required to meet in physical contact when the molded shell 2 is in the closed position, in which case a space may exist between the edges 12*a,b*.

Preferably, the inner contoured surfaces 20*a,b* are configured to define a cavity 14 having a size and shape suitable to receive a portion of the figurine 4, such as a torso, a limb, or a combination thereof, so that a portion of the molded shell 2 can be mounted onto a portion of the figurine 4. As seen in FIG. 1A, a portion of the molded shell 2 may encircle or surround a portion of the figurine 4 when the molded shell 2 is mounted onto a figurine 4.

More preferably, a portion of the cavity 14 as defined by the inner contoured surfaces 20*a,b* may approximate the contours of a portion of a figurine 4, such as a torso or limb, so that a the molded shell 2 can be securely mounted onto the figurine 4. In other words, the inner contoured surfaces 20*a,b* may be configured so that at least a portion of the molded shell 2 can fit in interlocking engagement with a portion of the figurine 4. For example, the inner contoured surfaces 20*a,b* of the contoured panels 6*a,b* defining the bodice of the dress-shaped molded shell 2 depicted in FIG. 1A define a cavity 14 that closely approximates the contours torso of the figurine 4. However, portions of the inner contoured surfaces 20*a,b* may not approximate the contours of a portion of the figurine 4. For example, the inner contoured surface 20*a,b* of the contoured panels 6*a,b* defining the skirt of the dress-shaped molded shell 2 shown in FIG. 1A extend away from the legs of the figurine 4.

The molded shell 2 may further be provided with an optional fastening member 16 positioned at the edges 12*a,b* of each contoured panel 6*a,b* opposite the hinge assembly 8. If included, the fastener 16 preferably couples the edges 12*a,b* of each contoured panel 6*a,b* together to retain the molded shell 2 in the closed position, but can be easily released to allow the molded shell 2 to be placed in the open position when desired. Suitable fastening members 16 are known in the art and can include but are not limited to friction fit snaps, clasps or magnets.

Figure 2B:
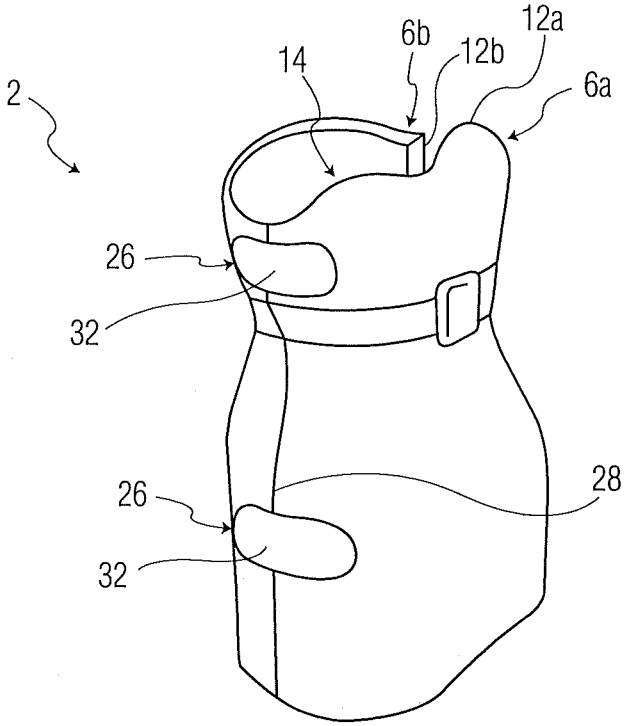
FIG. 2B is a perspective view of the contoured panels depicted in FIG. 2A assembled as a molded shell in a substantially closed position.

Turning now to FIGS. 2A-2B, details of the hinge assembly 8 are shown. The hinge assembly 8 comprises at least one pin member 22, a cut-out portion 24 (seen best in FIG. 2A) and a flexible material 26 (seen best in FIG. 2B). The cut-out portion 24 is formed in or defined by each contoured panel 6,*a,b* at adjacent positions in the contoured panel edge 28. The cut-out portions 24*a,b* of each contoured panel 6*a,b* are sized and positioned at the contoured panel edge 28 so that they jointly form a through-space 30 in the molded shell 2 when the contoured panels 6*a,b* are aligned. As shown in FIG. 2A, each cut-out portion 24*a,b* has a generally opposing U-shape so that the cut-out portions 24 jointly form an elliptical-shaped through-space 30. However, the shape of the through-space 30 is not critical and any other shape is suitable, such as circular, rectangular, triangular square or the like.

As shown in FIG. 2A, each contoured panel 6,*a,b* is further provided with at least one pin member 22*a,b* in the region of the cut-out portion 24*a,b*. As shown, each pin member 22 is fixed to a contoured panel 6 at each end and transverses the through-space 30 defined by the cut-out portions 24. As shown in FIG. 2A, the pin member 22 extends generally parallel to the edge 28 of the contoured panel 6. However, a pin member 22 may be fixed to a contoured panel 6 at only one end or may extend perpendicularly or be positioned at an angle to the contoured panel 6.

At least a portion of the flexible material 26 is positioned within the cut-out portion 24*a,b* of each contoured panel 6*a,b*. Additionally, as best seen by cross-sectional view in FIG. 3, at least a portion of the flexible material 26 also surrounds a portion of a pin member 22. In some examples, the pin members 22 can be completely surrounded by the flexible material 26.

Figure 3:
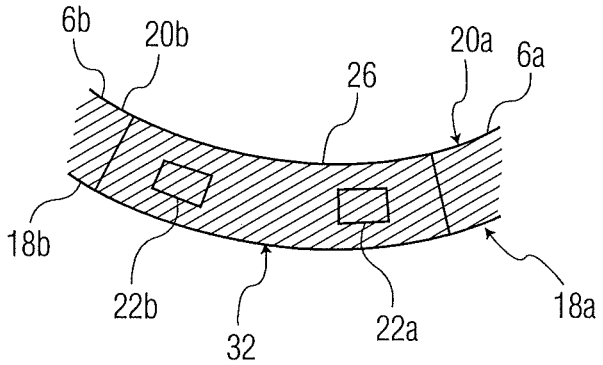
FIG. 3 is a cross-sectional view of the hinge assembly of the molded shell depicted in FIG. 2B.

As assembled in the molded shell 2, the flexible material 26 defines an outer surface 32 having a contour. As shown in FIG. 2B and FIG. 3, the contour of the outer surface 32 of the flexible material 26 of the hinge assembly 8 is continuous with the contours of the outer contoured surface 18 of the contoured panels 6. In other words, contours of the hinge assembly 8 can be flush with the outer contoured surface 18 of the contoured panels 6 such that there are no substantial protrusions extending away from the molded shell 2. This arrangement is aesthetically pleasing and can approximate the natural appearance of a real garment. While not critical, the contour of the surface of the flexible material 26 facing the cavity 14 may also be continuous with the inner contoured surface 20 of the contoured panels 6.

In preferred examples, the flexible material 26 may be adhered to the contoured panel 6 or pin member 22 where the flexible material 26 and contoured panel 6 or pin member 22 mutually contact.

In some examples, the molded shell 2 may be biased towards the closed position. For example, the material comprising the flexible material 26 may be a resiliently flexible material that is naturally biased towards the closed position. Accordingly, the molded shell 2 can be placed in the open position by forcing the contoured panels 6*a,b* to pivot away from one another, but is urged to return towards the closed position when the contoured panels 6*a,b* are released. Bias in the molded shell 2 towards the closed position facilitates mounting the molded shell to a figurine.

Turning now to FIGS. 4A-4D, an alternate example of a playset 110 is shown. This playset 110 comprises a plurality of molded shells 120*a*, 12*b*, 120*c* and 120*d* and figurine 140.

Figure 4A:
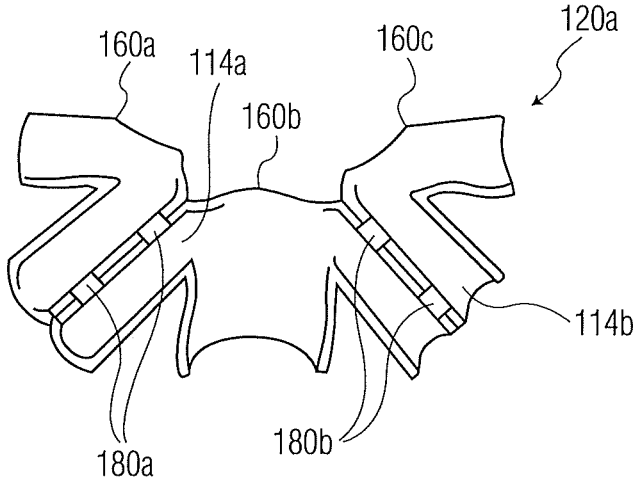
FIG. 4A is a perspective view of a further exemplary molded shell in an open position.

As shown in FIG. 4A, the molded shell 120*a* is an example of a molded shell that approximates the appearance of a long-sleeved jacket. It comprises three contoured panels 160*a,b,c*. The first contoured panel 160*a* is pivotally mounted to the second contoured panel 160*b* by hinge assembly 180*a* and the second contoured panel 160*b* is pivotally mounted to the third contoured panel 160*c* by hinge assembly 180*b*. Together, the first contoured panel 160*a* and second contoured panel 160*b* define a portion of a cavity 114*a* that can receive a portion of a limb and a portion of the torso of the figurine 140 when the molded shell 120*a* is mounted thereon. Likewise, the second contoured panel 160*b* and third contoured panel 160*c* define a portion of the cavity 114*b* that can receive a portion of an opposing limb and a portion of the torso of the figurine 140 when the molded shell 120*a* is mounted thereon.

Figure 4B:
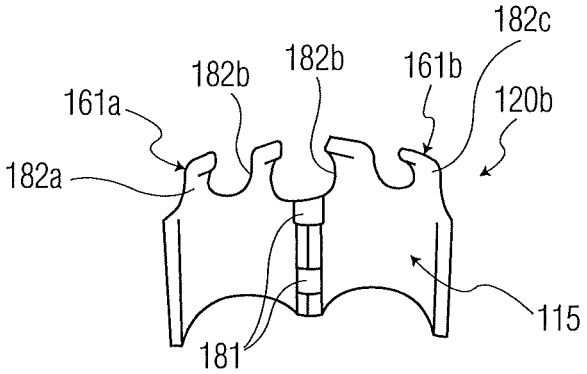
FIG. 4B is a perspective view of another exemplary molded shell in an open position.

As shown in FIG. 4B, the molded shell 120*b* is an example of a molded shell that approximates the appearance of a sleeveless shirt. It comprises two contoured panels 161*a,b* pivotally mounted to each other by hinge assembly 181. The contoured panels 161*a,b* define a cavity 115 that can receive a portion of the torso of the figurine 140. Additionally, the contoured panels 161*a,b* define extending members 182*a,b,c,d* which curve towards the extending member 182*a,b,c,d* of the opposing contoured panel 160. FIG. 4D shows the molded shell 120*b* mounted onto the figurine 140.

Figure 4C:
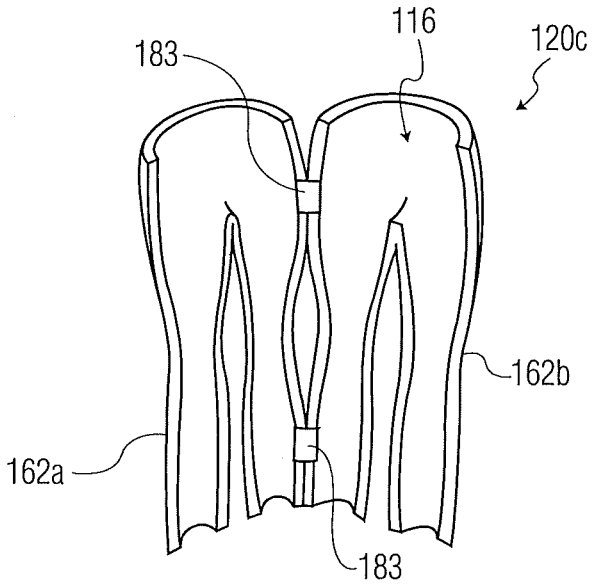
FIG. 4C is a perspective view of yet another exemplary molded shell in an open position.
Figure 4D:
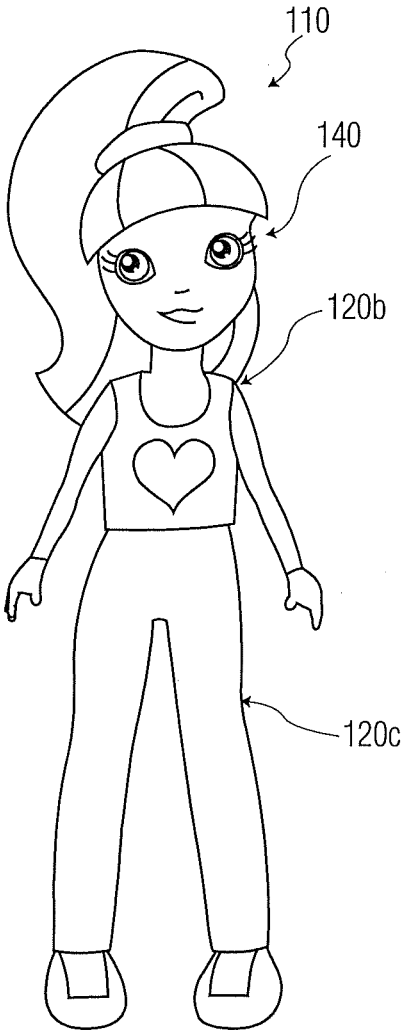
FIG. 4D is a perspective view of an exemplary play set with the molded shells depicted in FIGS. 4B and 4C mounted on an exemplary figurine.

As shown in FIG. 4C, the molded shell 120*c* is an example of a molded shell that approximates the appearance of a pair of pants. It comprises two contoured panels 162*a,b* pivotally mounted to each other by hinge assembly 183. The contoured panels 162*a,b* define a partially bifurcated cavity 116 that can receive a portion of both of the lower limbs and torso of the figurine 140. FIG. 4D shows the molded shell 120*c* mounted onto the figurine 140.

Additionally, in playsets having a plurality of molded shells, one or more molded shells may be configured so that at least a second molded shell can be mounted onto a figurine over a portion of a first molded shell. In such a play set, the second molded shell may have an inner contoured surface configured to define a cavity having a size and shape suitable to receive a portion of a first molded shell mounted onto a portion of the figurine 4, such as a torso, a limb, or a combination thereof, so that a portion of the first and second molded shells can be layered onto a portion of the figurine 4. Preferably, a portion of the cavity of the second molded shell as defined by the inner contoured surfaces may approximate a portion of the outer contoured surface of the first molded shell so that both molded shells can be securely mounted onto a figurine.

Molded shells may also be provided with through-holes, transparent portions or windows that allow a portion of an underlying figurine or additional molded shell to be visualized when the molded shell in mounted thereon. Additionally, the through-holes may be configured so that a portion of the figurine can pass through the through-hole.

Turning now to the manufacturing of playsets 10, it is noted that each contoured panel 6 is preferably formed from a rigid or semi-rigid material. Suitable materials for forming the contoured panels 6 include but are not limited to acrylonitrile butadiene styrene, high impact polystyrene, polypropylene, harder grades of polyvinyl chloride and the like. Acrylonitrile butadiene styrene and high impact polystyrene are preferred. Additionally, although at least a portion of the molded shell 2 is formed from a rigid or semi-rigid material, it will be appreciated that fabric or other non-rigid materials may also be attached to the molded shell 2 as desired.

For convenience and cost-reduction, the contoured panels 6 of the molded shell 2 can be formed using known polymer molding techniques, including but not limited to injection or vacuum molding. Preferably, the each contoured panel 6 is molded with a cut-out portion 24 and pin member 22 as one-piece to provide unitary construction. However, the components of the contoured panels 6 can be prepared separately and assembled. Additionally, it will be appreciated that, although the molded shell 2 is referred to herein as "molded," a suitable molded shell 2 can be formed by other known methods, such as, but not limited to, carving, 3D printing or the like.

The flexible material 26 of the hinge assembly 8 can be any flexible material. While the flexible material 26 is referred to as "flexible," it should be appreciated that it may have a relatively high hardness so long as it is not rigid. For example, the flexible material 26 may be formed from a material having a Shore hardness of about 70 A or more. In preferred examples, the flexible material 26 is resiliently flexible. Suitable materials include but are not limited to thermoplastic elastomer, kraton, and styrene-butadiene-styrene block copolymers.

To assemble a molded shell 2 from individual contoured panels 6, the contoured panels 6 are typically placed together to align the cut-out portion 24 of each contoured panel 6. A flexible material can then be applied into the through-opening 30 of the molded shell 2 to form the hinge assembly 8. While any technique is suitable for assembling a molded shell 2 with a hinge assembly 8, overmolding is preferred. A suitable overmolding technique may include assembling the contoured panels 6 on a core die and placing the assembly within a cavity die. An elastomeric material in liquid form can be injected into the cavity die in the region of the cut-out portions 24 to cause the elastomer to fill a through-opening 30 of the molded shell 2. When the elastomeric material cures, it forms the flexible material 26 of the hinge assembly 8 that pivotally attaches the contoured panels 6 to one another. This technique or others can be readily adapted for manufacturing a molded shell 2 comprising a plurality of contoured panels 6 and/or a plurality of hinge assemblies 8. For example, it will be appreciated that an elastomeric material can be formed first, placed into a mold, and the contoured panels may then be formed by injecting a polymer material into the mold.

It will be appreciated that, although the play sets 10 and 110 are described above as comprising at least one molded shell 2 and a figurine 4, the molded shell 2 and figurine 4 can be provided separately. For example, one or more molded shells 2 can be packaged for use as alternate garments with a figurine 4 that is packaged separately.

Although the apparatus and methods have been described in connection with specific forms thereof, it will be appreciated that a wide variety of equivalents may be substituted for the specified elements described herein without departing from the spirit and scope of this disclosure as described in the appended claims. Additionally, all publications, including but not limited to patents and patent applications, cited in this disclosure are herein incorporated by reference as though fully set forth.

What is claimed is:

1. A play set comprising a molded shell which comprises:

a) at least two contoured panels, each contoured panel having an inner contoured surface and an outer contoured surface, and b) at least one hinge assembly comprising at least two pin members, with each pin member fixed to one of the contoured panels, and a flexible material surrounding the pin members, wherein the hinge assembly joins the contoured panels.

2. The play set of claim 1, wherein a contour of an outer surface of the hinge assembly is continuous with the outer contoured surface of the contoured panels.

3. The play set of claim 1, wherein each of the contoured panels defines a cut-out and wherein the pin member transverses the cut-out.

4. The play set of claim 3, wherein a portion of the flexible material is positioned within the cut-out of each contoured panel.

5. The play set of claim 1, further comprising a doll, figurine, or vehicle.

6. The play set of claim 1, further comprising at least a second molded shell.

7. The play set of claim 1, wherein at least a portion of the molded shell defines a cavity configured to receive a portion of a doll, figurine or vehicle.

8. The play set of claim 1, wherein at least a portion of the inner contoured surface approximates a portion of a contour of a doll, figurine or vehicle.

9. The play set of claim 1, wherein the outer contoured surface approximates the appearance of a garment.

10. The play set of claim 1, wherein the molded shell further comprises at least one fastening member.

11. The play set of claim 1, wherein the molded shell is formed from a rigid material.

12. The play set of claim 1, wherein at least one of the contoured panels and at least one pin member are of unitary construction.

13. The play set of claim 1, wherein the flexible material is formed from a resiliently flexible material.

14. The play set of claim 1, wherein the molded shell comprises more than two contoured panels.

15. The play set of claim 1, wherein the molded shell comprises a plurality of hinge assemblies.

16. The play set of claim 6, wherein at least a portion of the second molded shell of defines a cavity configured to receive a portion of another molded shell and a portion of a doll, vehicle or figurine.

17. The play set of claim 1, wherein the molded shell comprises at least one through-hole or transparent portion.

18. The play set of claim 1, wherein the molded shell is biased towards a closed position.

* * * * *